US006910415B1

(12) United States Patent
Reichel

(10) Patent No.: US 6,910,415 B1
(45) Date of Patent: Jun. 28, 2005

(54) PRINTING UNIT CYLINDER FOR A ROTARY PRINTING MACHINE

(75) Inventor: Klaus T. Reichel, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/607,890

(22) Filed: Jun. 30, 2000

(30) Foreign Application Priority Data

Jul. 1, 1999 (DE) ..... 199 30 480

(51) Int. Cl.[7] ..... B41L 27/34

(52) U.S. Cl. ..... 101/212; 101/368; 101/487; 492/28; 492/46; 492/48; 492/54; 492/58

(58) Field of Search ..... 101/368, 487, 101/377, 212; 492/4, 19, 28, 46, 48, 50, 53, 492/54, 58

(56) References Cited

U.S. PATENT DOCUMENTS 3,791,037 A * 2/1974 DiCiaccio et al. ..... 33/125 R
3,867,748 A * 2/1975 Miller ..... 29/115
4,144,811 A * 3/1979 Barnett ..... 101/349.1
5,040,398 A * 8/1991 Nakagawa et al. ..... 72/199
5,048,168 A * 9/1991 Vanaschen et al. ..... 432/246
5,061,533 A * 10/1991 Gomi et al. ..... 428/36.3
5,740,736 A * 4/1998 Toyoda ..... 101/218
5,896,662 A * 4/1999 Matsuzawa et al. ..... 29/895.21
5,925,496 A * 7/1999 Ghosh et al. ..... 430/270.1
6,050,190 A * 4/2000 Knauer et al. ..... 101/216
6,065,382 A * 5/2000 Titz et al. ..... 83/341
6,082,202 A * 7/2000 Hussain ..... 73/861.357

FOREIGN PATENT DOCUMENTS

DE 39 07 528 A1 9/1990
DE 196 19 655 A1 2/1997
EP 697 284 A2 2/1996

OTHER PUBLICATIONS

Japan New Materials Report, "Invar: A Brief Introduction".*
Hot Walton & Hill, "Invar-Nickel Iron Alloy".*

* cited by examiner

*Primary Examiner*—Andrew H. Hirshfeld
*Assistant Examiner*—Kevin D. Williams
(74) *Attorney, Agent, or Firm*—Cohen, Pontani, Lieberman & Pavane

(57) ABSTRACT

A printing unit cylinder is subject to only low deformation in the event of operationally induced increases in the temperature of the printing unit. At least the barrel of the body of the printing unit cylinder is produced from a metallic material with a linear coefficient of expansion of $\alpha<5\times10^{-6}K^{-1}$ in a temperature range of from about 20° to about 60°.

7 Claims, 1 Drawing Sheet

PRINTING UNIT CYLINDER FOR A ROTARY PRINTING MACHINE

BACKGROUND OF THE INVENTION

1. Field of the Invention

The present invention relates to a printing-unit cylinder for a rotary printing machine. More particularly, the present invention relates to a transfer cylinder, a plate cylinder or a back pressure cylinder. The present invention further relates to a barrel, a body and an entire printing unit cylinder for effectively dissipating undesired heat during the printing process.

2. Description of the Related Art

When using a transfer cylinder in a rotary printing machine, flexure work in the rubber blanket during rolling contact with a plate cylinder and a back-pressure cylinder produces dissipation energy and results in undesirable heating of the rubber blanket. EP 0 697 284.A1 suggests a solution to the problem by providing internal cooling. However, this internal cooling system is complex and can cause problems in both producing the system and in operating it.

DE 196 19 655 A1 suggests an improvement in heat transfer between the rubber blanket and the transfer cylinder bearing the blanket. It is proposed that the rubber blanket contain a heat-dissipating inlay or underlay designed to dissipate the heat radially to the transfer cylinder. However, in this system localized differences in heating of the blanket still occur. These local temperature differences can be caused by the subject or as a result of the blanket having variations in compressibility. These variations may be caused by a lack of a homogenous blanket material. As a result, the differences in heating over the blanket are transmitted to the transfer cylinder which then has variations in temperature. Non-uniform heating of the transfer cylinder can in turn lead to deformation such as curvature of its longitudinal axis with resultant disruption of ink transfer. This impairs the printing quality.

Non-uniform heating as discussed may also occur on other printing-unit cylinders, for example plate cylinders. The same cylinder deformations and impairment to the printing quality can occur in this instance as well.

SUMMARY OF THE INVENTION

The object of the invention is to provide a printing-work cylinder which addresses the problems of the prior art.

A further object of the present invention is to provide a printing-work cylinder that is subject only to low deformation even under operating conditions which increase the temperature of the printing unit.

Briefly stated, the present invention is a printing unit cylinder for a rotary printing machine including a cylinder made of a metallic material having a linear coefficient of expansion of about $\alpha<5\times10^{-6}K^{-1}$ in a temperature range of from about 20° to about 60°.

According to an embodiment, a printing unit cylinder is made of a metallic material having a linear coefficient of expansion of about $\alpha<1.5\times10^{-6}K^{-1}$ in a temperature range of from about 20° to about 60°.

According to another embodiment of the present invention, a printing unit cylinder is made of an iron alloy having from about 30% to about 40% nickel by weight.

According to another embodiment of the present invention, a printing unit cylinder is made of an iron alloy having about 36% nickel by weight.

A cylinder for a rotary printing unit made according to the present invention will deform only slightly under conditions where regions of the cylinder are heated to a greater extent than other regions on the cylinder. The low coefficient of expansion results in the regions on the cylinder having the greater temperature expanding only slightly more as compared to the regions on the cylinder having a lower temperature. As a result, the minor deformation of the cylinder has little to no influence on ink transfer and thus causes little to no impairment of the printing quality. As a result of this low bending of the transfer cylinder, during operation of the printing unit, the pressure on the rubber blanket increases only to an insignificant degree with the associated introduction of heat. As a result, deformation or bending of printing unit cylinders does not escalate.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further noted that the drawings are merely intended to conceptually illustrate the structures and procedures described herein.

BRIEF DESCRIPTION OF THE DRAWINGS

In the associated drawings, in schematic form.

DETAILED DESCRIPTION OF THE PRESENTLY PREFERRED EMBODIMENTS

Figure 1:
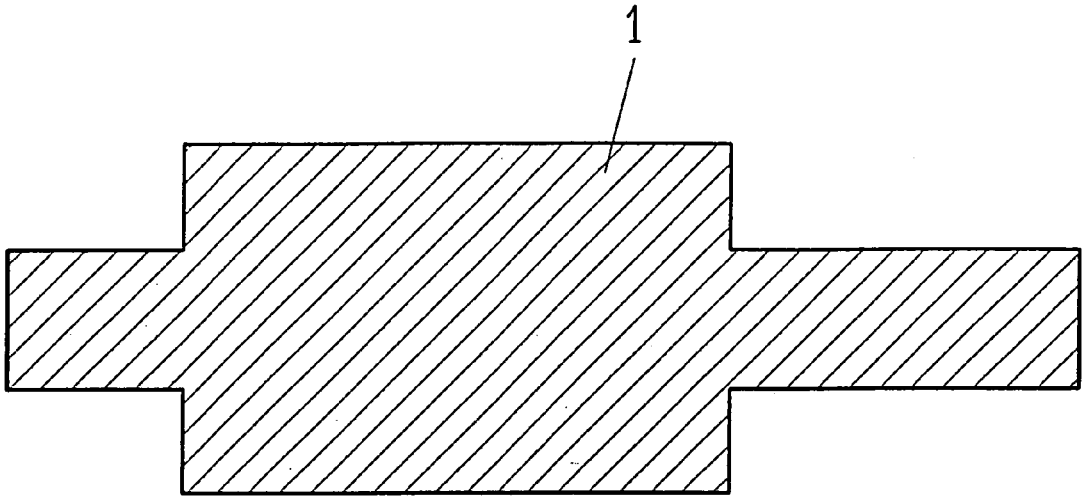
FIG. 1 shows a printing unit cylinder, which consists completely of a metallic material with a low coefficient of expansion.

FIG. 1 shows a printing unit cylinder 1, made completely of a metallic material with a linear coefficient of expansion of $\alpha<5\times10^{-6}K^{-1}$ in a temperature range of from about 20° to about 60°. An embodiment of the present invention is a printing-unit cylinder 1 made from an iron alloy having 36% nickel by weight. The iron/nickel alloy proposed is described in "Nickel und Nickellegierungen" [Nickel and Nickel Alloys] by K. E. Volk, Springer-verlab Berlin, Heidelberg, New York, 1970, pages 27 to 39. Iron having this proportion of nickel has an average coefficient of expansion in the temperature range of from 0° C. to 100° C. of about $\alpha<5\times10^{-6}K^{-1}$. This is approximately 10 to 20 times less than the conventional steel used for production of the cylinder. The proportion of nickel can lie in the range of between 30% and 40% by weight, while retaining an acceptable but higher coefficient of expansion. For adequate dimensional stability of the printing unit cylinder 1, the linear coefficient of expansion should lie below $5\times10^{-6}K^{-1}$.

Figure 2:
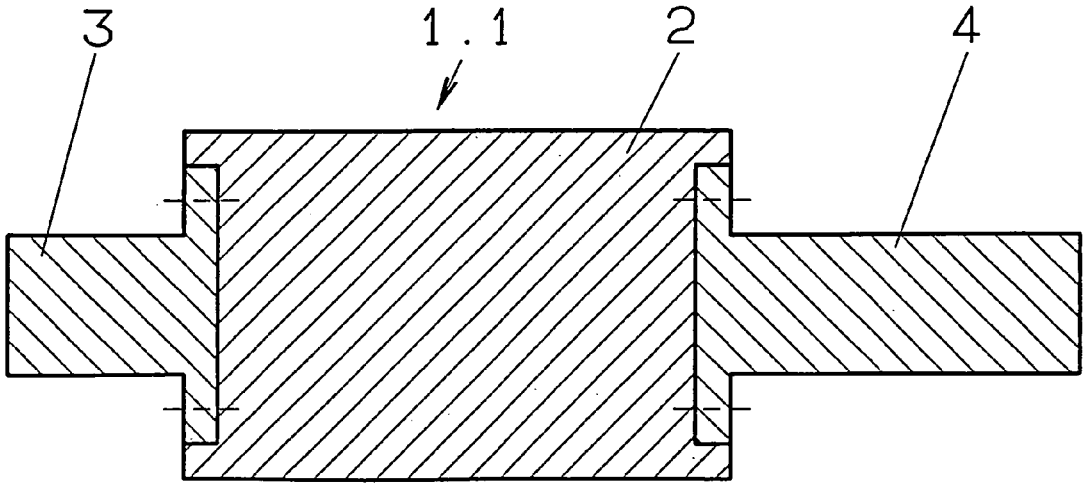
FIG. 2 shows a printing unit cylinder whose body consists of a metallic material with a low coefficient of expansion.

FIG. 2 shows a printing unit cylinder 1.1 in which only the barrel 2 of the body of the cylinder is made from an iron/nickel alloy having a linear coefficient of expansion $\alpha<5\times10^{-6}K^{-1}$ in a temperature range of from about 20° to about 60°. The two journals 3, 4 are made from a less expensive steel and are screwed onto the body 2 of the cylinder at the ends. In this design as well, the printing unit cylinder 1.1 possesses good dimensional stability when non-uniform heating occurs during use.

The printing unit cylinders 1 and 1.1 described can be, for example, plate cylinders, transfer cylinders or back-pressure cylinders.

Thus, while there has been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A printing unit cylinder for a rotary printing machine, said printing unit cylinder being a transfer cylinder for receiving a rubber blanket in which localized temperature differences occur, said printing unit cylinder comprising a body having a barrel as a centerpiece and two journals, a respective one of the journals being on each end of the barrel; the entire barrel being made completely of a metallic material having a linear coefficient of expansion of about $\alpha<5\times10^{-6}K^{-1}$ in a temperature range of from about 20° to about 60°.

2. A printing unit cylinder for a rotary printing machine according to claim 1, wherein said metallic material has a linear coefficient of expansion of about $\alpha<1.5\times10^{-6}K^{-1}$ in a temperature range of from about 20° to about 60°.

3. The printing unit cylinder as claimed in claim 1, wherein said metallic material is an iron alloy having about 30% to about 40% nickel by weight.

4. The printing unit cylinder as claimed in claim 3, wherein said metallic material is an iron alloy having about 36% nickel by weight.

5. The printing unit cylinder according to claim 1, wherein the entire cylinder is made of said metallic material.

6. The printing unit cylinder according to claim 3, wherein the entire cylinder is made of said iron alloy.

7. The printing unit cylinder according to claim 4, wherein the entire cylinder is made of said iron alloy.

* * * * *